US012420994B2

(12) United States Patent
Sedlak

(10) Patent No.: US 12,420,994 B2
(45) Date of Patent: Sep. 23, 2025

(54) CAP CLOSURE UTILIZING AXIALLY SLIDING RAIL SYSTEM

(71) Applicant: QUALIPAC AMERICA CORP., Woodland Park, NJ (US)

(72) Inventor: Brian Sedlak, High Bridge, NJ (US)

(73) Assignee: QUALIPAC AAMERICA CORP., Woodland Park, NJ (US)

( * ) Notice: Subject to any disclaimer, the term of this patent is extended or adjusted under 35 U.S.C. 154(b) by 78 days.

(21) Appl. No.: 18/233,694

(22) Filed: Aug. 14, 2023

(65) Prior Publication Data

US 2024/0059463 A1 Feb. 22, 2024

Related U.S. Application Data

(60) Provisional application No. 63/400,000, filed on Aug. 22, 2022.

(51) Int. Cl.
*B65D 47/28* (2006.01)

(52) U.S. Cl.
CPC ..... *B65D 47/286* (2013.01)

(58) Field of Classification Search
CPC .. B65D 47/061; B65D 47/242; B65D 47/246; B65D 47/263; B65D 47/26; B65D 47/28; B65D 47/286; B65D 90/587
See application file for complete search history.

(56) References Cited

U.S. PATENT DOCUMENTS

| | | | | |
|---|---|---|---|---|
| 1,214,600 | A * | 2/1917 | Silverthorne | B65D 47/061 222/482 |
| 7,481,339 | B1 * | 1/2009 | Hsu | B65D 47/286 215/322 |
| 9,914,566 | B2 * | 3/2018 | Chevalier | B65D 47/286 |
| 11,472,611 | B1 * | 10/2022 | Hove | B65D 47/14 |
| 2017/0341922 | A1 * | 11/2017 | Morgan | B65D 47/286 |

* cited by examiner

*Primary Examiner* — Donnell A Long
(74) *Attorney, Agent, or Firm* — H&I PARTNERS; Chai Im; C. Andrew Im

(57) ABSTRACT

A cap closure having a top portion, a bottom portion having a dispensing orifice and a rail system. The rail system mechanically adheres the top portion to the bottom portion. The rail system includes at least two rail tracks on the bottom portion and at least two individual rails on the top portion. The two individual rails move axially along the two rail tracks to move the cap closure from a closed position to an open position to provide access to the dispensing orifice and vice-versa to close access to the dispensing orifice.

12 Claims, 4 Drawing Sheets

CAP CLOSURE UTILIZING AXIALLY SLIDING RAIL SYSTEM

RELATED APPLICATION

This application claims the benefit of U.S. Provisional Application No. 63/400,000 filed Aug. 22, 2022, which is incorporated herein by reference in its entirety.

FIELD OF INVENTION

The claimed invention relates to a cap closure onto a bottle for production dispensation. More specifically, the claimed invention allows an end-user to open and close the cap closure in a novel manner by using a built-in rail system that allows the cap to slide open and closed.

BACKGROUND OF THE INVENTION

In contrast, there are many variations of cap closures on the market today, but they primarily open in standard ways, such as axially pushing the closure or pulling the closure off, unscrewing rotating the closure open or off, using a button or disc to allow for press top or tilt top opening and closing, or using a flip-top closure design to open and close the closure.

It is generally known that a cap closure may use axial forces or torque to open and close a product.

OBJECT AND SUMMARY OF THE INVENTION

In accordance with an exemplary embodiment of the claimed invention, the cap closure system utilizes a rail system that allows the top portion ('disc') and bottom portion ('body') of the caps to mechanically adhere together. The claimed cap closure system allows the top portion to move along a track, utilized for both gaining access to the dispensing orifice of the package and as well as closing it for sealing. The claimed cap closure system also comprises a 'plug' that is mechanically fitted to the pintle of the top portion ('disc'). The 'plug' makes the seal with the dispensing orifice of the bottom portion ('body'). The claimed cap closure system also comprises a 'gasket' that is mechanically fitted to the pintle of the bottom portion ('body'). The 'gasket' makes the seal with the bottle containing the product.

In accordance with an exemplary embodiment of the claimed invention, the cap closure's versatility in geometrical design can be employed in using any number of shapes, such as round or square cap closures. Additionally, the dispensing outlet may be designed in any number of variations for the dispensing orifice of the product (i.e., round, square, oval, etc.).

In accordance with an exemplary embodiment of the claimed invention, a cap closure comprises a top portion, a bottom portion comprising a dispensing orifice and a rail system. The rail system mechanically adheres the top portion to the bottom portion. The rail system comprises at least two rail tracks on the bottom portion and at least two individual rails on the top portion. The two individual rails move axially along the two rail tracks to move the cap closure from a closed position to an open position to provide access to the dispensing orifice and vice-versa to close access to the dispensing orifice.

In accordance with an exemplary embodiment of the claimed invention, the aforesaid two individual rails mate with a corresponding rail track to fit the top portion to the bottom portion and to prevent the top portion from being dislodged from the bottom portion.

In accordance with an exemplary embodiment of the claimed invention, the aforesaid top portion comprises a pintle, and the aforesaid cap closure further comprises a plug mechanically fitted to the pintle. The plug is configured to make a seal with the dispensing orifice on the bottom portion.

In accordance with an exemplary embodiment of the claimed invention, the aforesaid cap closure is configured to be removably attached to a bottle containing a product. The product is dispensed through the dispensing orifice in the open position of the cap closure.

In accordance with an exemplary embodiment of the claimed invention, the aforesaid bottom portion comprises a body pintle, and the aforesaid cap closure further comprises a gasket mechanically fitted to the body pintle.

In accordance with an exemplary embodiment of the claimed invention, the aforesaid gasket is configured to seal the bottle to prevent the product from leaking into the threaded area when the cap closure is properly tightened on the bottle.

In accordance with an exemplary embodiment of the claimed invention, the aforesaid cap closure comprises an assembly of the gasket and the body pintle that is configured to fit to an opening of a bottle neck of the bottle. Preferably, the geometry of the assembly varies depending on the size of the opening of the bottle neck.

In accordance with an exemplary embodiment of the claimed invention, the aforesaid product is a powder, liquid, cosmetic product, water, liquid soap, medicine or the like.

In accordance with an exemplary embodiment of the claimed invention, the aforesaid cap closure comprises a directional marker on the top portion to provide an opening direction of the cap closure.

In accordance with an exemplary embodiment of the claimed invention, an assembly comprises the aforesaid cap closure removably attached to a bottle containing a product. The aforesaid two individual rails move axially along the aforesaid two rail tracks to move the cap closure from the closed position to the open position to dispense the product from the bottle via the dispensing orifice.

The choice of material can be comprised of virgin fossil-fuel based, post-consumer recycled, post-industrial recycled, chemically recycled, bio-based plastics, or any suitable or equivalent plastic resin. All the material in the claimed invention can be comprised of virgin or recyclable material. This allows market differentiation in that not all cap closures, such as flip-top caps for example, are mechanically strong enough to utilize recycled content.

BRIEF DESCRIPTION OF THE DRAWINGS

The following detailed descriptions, given by way of example, and not intended to limit the present invention solely thereto, will be best be understood in conjunction with the accompanying figures.

DETAILED DESCRIPTION OF THE DRAWINGS

Figure 1:
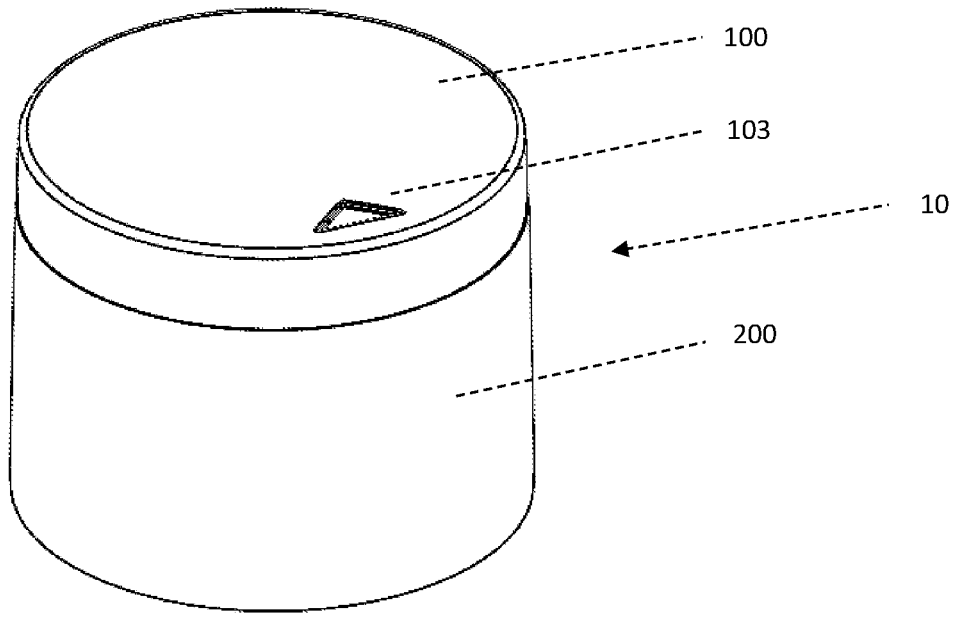
FIG. 1 is a detailed view of a cap closure fully closed in accordance with an exemplary embodiment of the claimed invention.

Turning now to FIG. 1, in accordance with an exemplary embodiment of the claimed invention, there is an illustration of a cap closure 10 with a top portion or disc 100 and a bottom portion or body 200 in a fully closed position. Directional marker 103 is given to detail to the end-user the direction of opening on the cap closure 10. The direction marker 103 can be designed in a variety of ways, such as a singular or multiple set of arrows, a finger or thumb print marker, or any variation of geometry that would work as indicator for closure opening direction.

Figure 2:
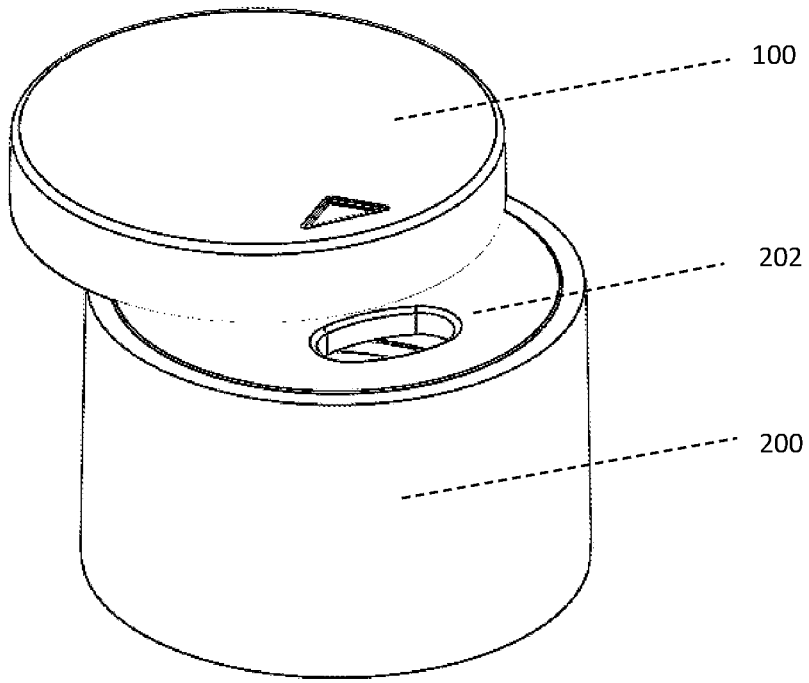
FIG. 2 is a detailed view of a cap closure fully opened in accordance with an exemplary embodiment of the claimed invention.

In accordance with an exemplary embodiment of the claimed invention, FIG. 2 shows the cap closure 10 with the disc 100 and the body 200 in a fully opened position. In the opened position, the product can be dispensed by the customer or end-user through a dispensing orifice 202. The applications for the claimed cap closure device 10 are not limited to cosmetic products and may be used to dispense any number of products, such as powder, water, liquid soap, medicines, or any other liquids that can sufficiently fit through the product dispensing orifice 202.

Figure 3:
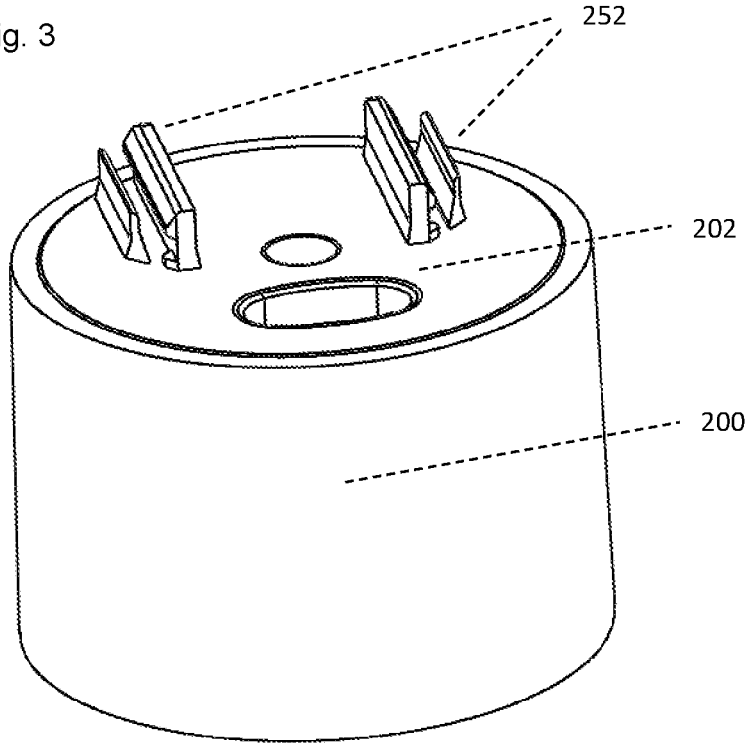
FIG. 3 is a detailed view of a cap closure's body rail system design and dispensing orifice design in accordance with an exemplary embodiment of the claimed invention.
Figure 4:
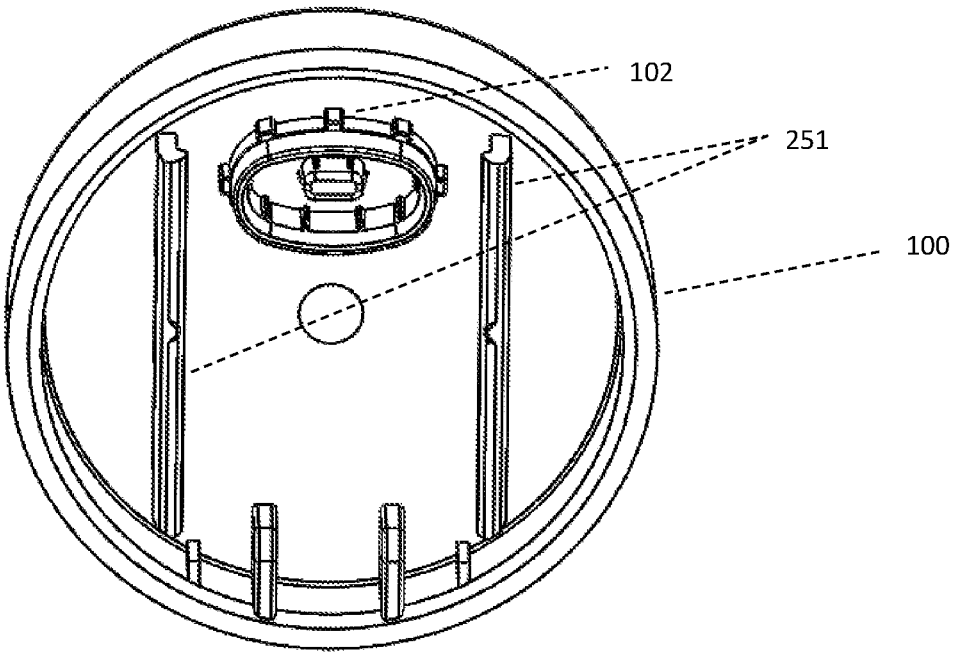
FIG. 4 is a detailed view of a cap closure's disc rail system design and pintle design in accordance with an exemplary embodiment of the claimed invention.

In accordance with an exemplary embodiment of the claimed invention, as shown in FIGS. 3 and 4, the rail system 250 comprises at least two rail tracks 252 on the body 200 and at least two individual rails 251 on the disc 100. The two individual rails 251 mates with the corresponding rail tracks 2521 to fit the disc 100 to the body 200. The rail system 250 prevents the disc 100 from being dislodged or easily removed from the body 200. The disc's main path of motion is axially along the two rail tracks 252. When the cap closure 10 is fully opened, the dispensing orifice 202 is fully accessible and the product can be evacuated.

Figure 5:
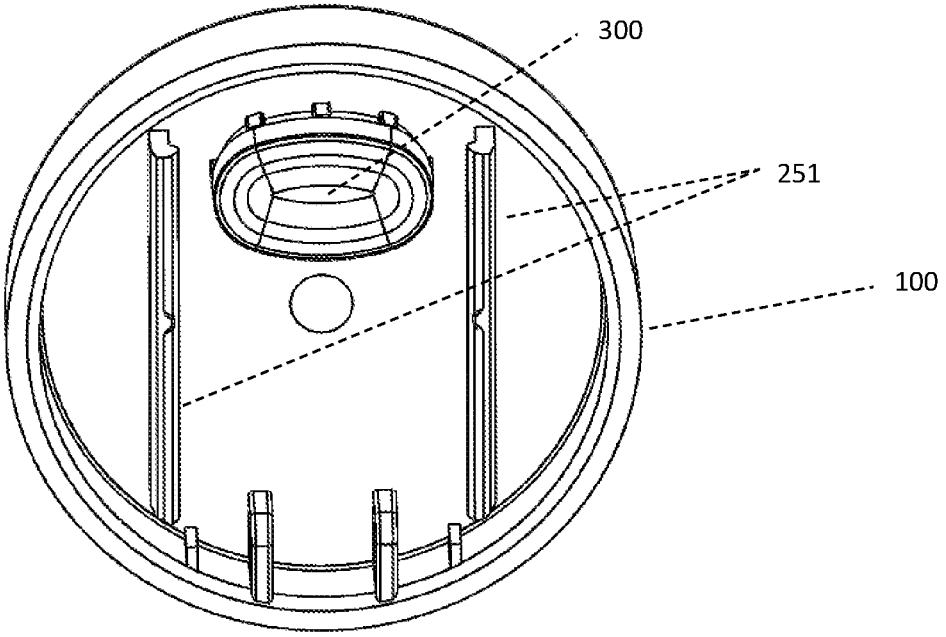
FIG. 5 is a detailed view of a cap closure's disc rail system design with the plug mechanically fitted to the pintle in accordance with an exemplary embodiment of the claimed invention.

As exemplary shown in FIG. 4, the disc 100 additionally comprises a pintle 102. In accordance with an exemplary embodiment of the claimed invention, the plug 300, exemplary shown in FIG. 5, is mechanically fitted with the pintle 102 of the disc 100. When the disc 100 is fully closed, the plug 300 fits to the body dispensing orifice 202 to ensure tightness and that the product is not easily evacuated.

Figure 6:
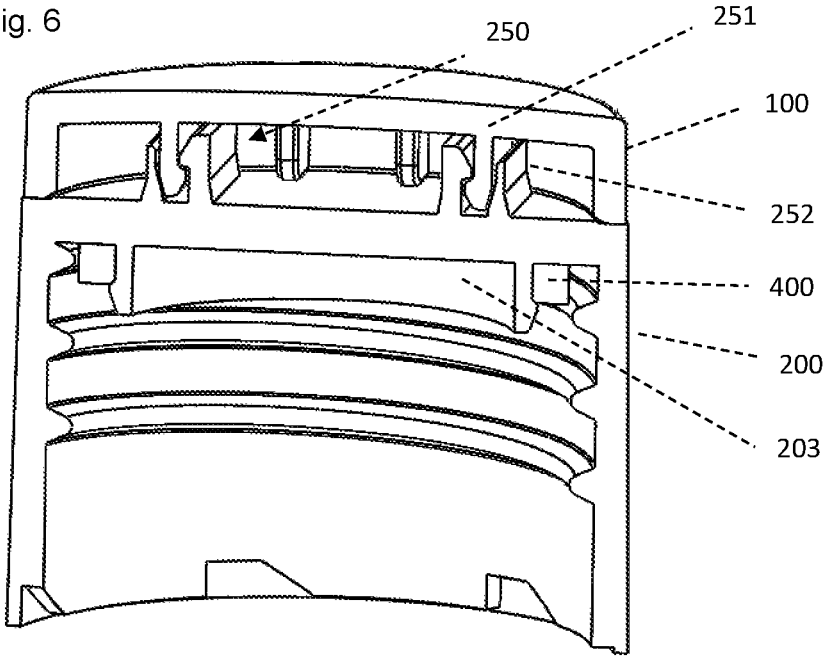
FIG. 6 is a detailed cross-sectional view of the cap closure's disc rail system in accordance with an exemplary embodiment of the claimed invention.

In accordance with an exemplary embodiment of the claimed invention, FIG. 6 shows a cross-sectional view of a rail system fitment between the disc 100 and the body 200. The rail system 250 is mechanically fitted together, and the disc 100 can move axially along the tracks of the rail system 250 in a forward or backward direction.

Figure 7:
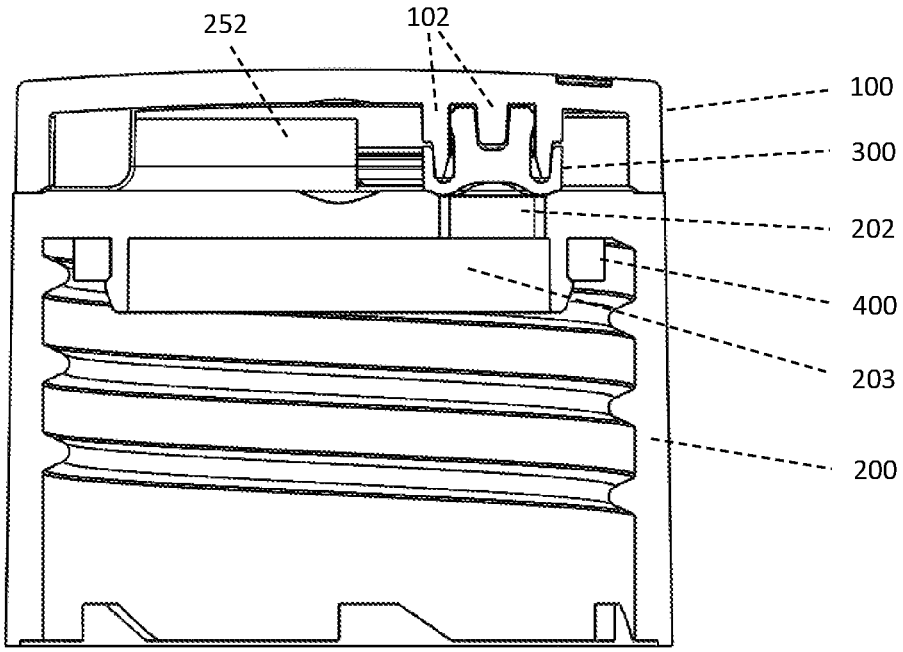
FIG. 7 is a detailed cross-sectional view of the cap closure through the sealing area in accordance with an exemplary embodiment of the claimed invention.

In accordance with an exemplary embodiment of the claimed invention, FIG. 7 shows a cross-sectional view of the sealing between the disc 100 and the body 200 in the closed position. The assembled plug 300 and pintle 102 on the disc 100 is fitted to the dispensing orifice 202 on the body 200. When the disc 100 is in a closed position, the product cannot be dispensed until the disc 100 is pushed into the open position. In accordance with an exemplary embodiment of the claimed invention, the cap closure 10 comprises a gasket 400 mechanically fitted to a body pintle 203 to make the seal with a bottle containing the product to prevent the product from leaking into a threaded area when the cap is tightened on the bottle. The assembly of gasket 400 and body pintle 203 are designed to fit to the opening of a bottle neck, and the geometry can be manipulated to fit and seal to any number of custom or stock bottle openings.

The claimed invention, having been described, will make apparent to those skilled in the art that the same may be varied in many ways without departing from the spirit and scope of the invention. Any and all such modifications are intended to be included within the scope of the following claims.

The invention claimed is:

1. A cap closure comprising:

a top portion comprising a pintle and a plug mechanically fitted to the pintle;

a bottom portion comprising a dispensing orifice;

a rail system to mechanically adhere the top portion to the bottom portion, the rail system comprises at least two rail tracks on the bottom portion and at least two individual rails on the top portion;

wherein said at least two individual rails move axially along said at least two rail tracks to slide the plug across a surface of the bottom portion and move the cap closure from a closed position to an open position to provide access to the dispensing orifice and move the cap closure from the open position to the closed position to close access to the dispensing orifice; and wherein during the movement of the cap closure from the open position to the closed position, the plug fits to the body dispensing orifice to seal the dispensing orifice.

2. The cap closure of claim 1, wherein said at least two individual rails mate with a corresponding rail track to fit the top portion to the bottom portion and to prevent the top portion from being dislodged from the bottom portion.

3. The cap closure of claim 1 configured to be removably attached to a bottle containing a product.

4. The cap closure of claim 3, wherein the product is dispensed through the dispensing orifice in the open position.

5. The cap closure of claim 3, wherein the bottom portion comprises a body pintle; and further comprises a gasket mechanically fitted to the body pintle.

6. The cap closure of claim 5, wherein the gasket is configured to seal the bottle to prevent the product from leaking into a threaded area when the cap closure is tightened on the bottle.

7. The cap closure of claim 6, wherein an assembly of the gasket and the body pintle is configured to fit to an opening of a bottle neck of the bottle.

8. The cap closure of claim 7, wherein a geometry of the assembly varies depending on a size of the opening of the bottle neck.

9. The cap closure of claim 3, wherein the product is a powder, liquid, cosmetic product, water, liquid soap, or medicine.

10. The cap closure of claim 1, further comprising a directional marker on the top portion to provide an opening direction of the cap closure.

11. The cap closure of claim 1 being made of recycled material.

12. An assembly comprising the cap closure of claim 1 removably attached to a bottle containing a product; and wherein said at least two individual rails moves axially along said at least two rail tracks to move the cap closure from the closed position to the open position to dispense the product from the bottle via the dispensing orifice.

* * * * *